US008701384B2

(12) United States Patent
Marchandise et al.

(10) Patent No.: US 8,701,384 B2
(45) Date of Patent: Apr. 22, 2014

(54) HALL EFFECT THRUSTER WITH COOLING OF THE INTERNAL CERAMIC

(75) Inventors: Frédéric Marchandise, Vernon (FR); Vaitua Leroi, Paris (FR); Stephan Zurbach, Vernon (FR); Dominique Indersie, Vernon (FR)

(73) Assignee: SNECMA, Paris (FR)

( * ) Notice: Subject to any disclaimer, the term of this patent is extended or adjusted under 35 U.S.C. 154(b) by 845 days.

(21) Appl. No.: 12/884,564

(22) Filed: Sep. 17, 2010

(65) Prior Publication Data

US 2011/0062899 A1 Mar. 17, 2011

(30) Foreign Application Priority Data

Sep. 17, 2009 (FR) ..... 09 56388

(51) Int. Cl.
*H05H 1/00* (2006.01)
*F03H 1/00* (2006.01)

(52) U.S. Cl.
USPC ..... 60/202; 60/203.1

(58) Field of Classification Search
USPC ..... 60/200.1, 202, 203.1; 313/359.1, 360.1, 313/361.1, 362.1, 363.1; 315/354–358
See application file for complete search history.

(56) References Cited

U.S. PATENT DOCUMENTS 5,539,258 A * 7/1996 Sutton et al. ..... 290/40 R
5,581,155 A * 12/1996 Morozov et al. ..... 315/111.21
5,945,781 A * 8/1999 Valentian ..... 315/111.81
6,075,321 A * 6/2000 Hruby ..... 315/111.91
6,281,622 B1 * 8/2001 Valentian et al. ..... 313/362.1
7,621,115 B2 * 11/2009 Furukawa ..... 60/202
2011/0089808 A1 * 4/2011 Harmann et al. ..... 313/359.1

FOREIGN PATENT DOCUMENTS

| | | |
|---|---|---|
| DE | 10 2007 062 150 | 4/2009 |
| EP | 0 982 976 | 3/2000 |
| FR | 2 693 770 | 1/1994 |
| FR | 2 924 473 | 6/2009 |
| JP | 2007-120424 | 5/2007 |

OTHER PUBLICATIONS

Saint Gobain Combat Boron Nitride Solids 2011 http://www.bn.saint-gobain.com/uploadedFiles/SGbn/Documents/Solids/Combat-Solids-DS1-R01.pdf.*

(Continued)

*Primary Examiner* — Phutthiwat Wongwian
*Assistant Examiner* — William Breazeal
(74) *Attorney, Agent, or Firm* — Preti Flaherty Beliveau & Pachios LLP

(57) ABSTRACT

The invention relates to the field of Hall effect thrusters. The invention provides a Hall effect thruster having a discharge channel of annular shape extending along an axis, the discharge channel being defined by an outer wall of annular shape and an inner wall of annular shape situated inside the space defined by the outer wall, a cathode situated outside the discharge channel, and an injector system situated at the upstream end of the discharge channel and also forming an anode, the downstream end of the discharge channel being open, wherein the thruster includes a heat sink device comprising a heat sink in contact with the inner wall and of thermal conductivity that is greater than the thermal conductivity of the inner wall, the heat sink being a sleeve and the heat sink device being suitable for discharging heat from the inner wall to the outside of the thruster so as to reduce the temperature difference between the inner wall and the outer wall.

10 Claims, 1 Drawing Sheet

(56) References Cited

OTHER PUBLICATIONS

Barral, Hall Effect Thruster with an AlN discharge channel 2005 The 29th International Electric Propulsion Conference p. 2 http://fluid.ippt.gov.pl/sbarral/publi/IEPC_2005_152.pdf.*
Fernie, Active metal brazing of ceramics 2000 TWI page 1 http://www.twi.co.uk/news-events/bulletin/archive/2000/january-february/active-metal-brazing-of-ceramics/.*
Weiner, Thermal Conductivity of Carbon Aerogels as a Function of Pyrolysis Temperature, 2006 International Journal of Thermophysics vol. 27, p. 1826 http://link.springer.com/article/10.1007%2Fs10765-006-0086-6#.*
Schwartz, Brazing, 2003, ASM, Second Edition p. 3.*
Wort, Thermal properties of bulk polycrystalline CVD diamond, 1994 , Elsevier, p. 1158 http://www.sciencedirect.com/science/article/pii/0925963594901627.*

* cited by examiner

HALL EFFECT THRUSTER WITH COOLING OF THE INTERNAL CERAMIC

FIELD OF THE INVENTION

The present invention relates to a Hall effect thruster having a discharge channel of annular shape extending along an axis, the discharge channel being defined by an outer wall of annular shape and an inner wall of annular shape situated inside the space defined by the outer wall, a cathode situated outside the discharge channel, and an injector system situated at the upstream end of the discharge channel and also forming an anode, the downstream end of the discharge channel being open.

A Hall effect thruster is a thruster used in the field of space propulsion, for example, since it enables spacecraft to be propelled in the vacuum of space while using a mass of fuel that is less than would be necessary for a chemically-fueled thruster, and it presents a lifetime that is long: several thousands of hours.

BACKGROUND OF THE INVENTION

Since the Hall effect thruster is known, its structure and its operating principle are briefly summarized below.

FIG. 2 is a view in perspective and partial section showing a Hall effect thruster 1. Around a central core 10 extending along a longitudinal axis A, there is situated a central magnetic coil 12. An inner wall 20 of annular shape surrounds the central magnetic coil 12 and the central core 10. The inner wall 20 is surrounded by an outer wall 40 of annular shape, such that between them these two walls define an annular channel extending along the axis A and referred to as the discharge channel 50.

In the description below, the term "inner" designates a portion that is closer to the axis A, and the term "outer" designates a portion that is further from the axis A.

The upstream end of the discharge channel 50 is closed by an injector system 30 that injects atoms into the discharge channel 50, and that also constitutes an anode. The downstream end 52 of the discharge channel 50 is open.

A plurality of peripheral magnetic coils 14 are situated around the outer wall 40. The central magnetic coil 12 and the peripheral magnetic coil 14 serve to generate a radial magnetic field B of intensity that is at a maximum towards the downstream end 52 of the discharge channel 50.

A hollow cathode 100 is situated outside the outer wall 40, and a potential difference is established between the cathode 100 and the anode (injector system 30). The hollow cathode 100 is positioned in such a manner as to eject electrons in the vicinity of the downstream end 52 of the discharge channel 50.

Inside the discharge channel 50, these electrons head towards the injector system 30 under the influence of the electric field generated by the potential difference between the cathode 100 and the anode, however some of them are trapped by the magnetic field B close to the downstream opening 52 of the discharge channel 50.

The electrons are thus caused to describe circumferential trajectories in the discharge channel 50 at its downstream opening 52. By impact, these electrons then ionize atoms of inert gas (generally xenon Xe) flowing from upstream to downstream in the discharge channel 50, thereby creating ions. These electrons also create an axial electric field E that accelerates the ions away from the anode (injector system 30 at the bottom of the channel 80) towards the downstream opening 52, such that the ions are ejected at high speed from the discharge channel 50 through its downstream end 52, thereby generating the thrust of the thruster.

When starting the Hall effect thruster, and after a repeated number of such starts, the operation of the Hall effect thruster is observed to become unstable, i.e. ions are ejected from the discharge channel in a manner that is not stable over time. This instability generates magnetic emissions that lead to insufficient performance from the Hall effect thruster.

This instability can be minimized by reducing the voltage between the cathode and the anode while starting. However that solution reduces the overall performance of the Hall effect thruster.

It is also possible to correct the instability by modifying the magnetic field B. However that correction requires an additional electronic device to be installed and used, thus necessarily consuming energy and thus making the Hall effect thruster more expensive to fabricate and presenting a lifetime that is shorter.

OBJECT AND SUMMARY OF THE INVENTION

The present invention seeks to remedy those drawbacks.

The invention proposes a Hall effect thruster that presents little or no instability while starting, performance that is not decreased, even over the long term, and a lifetime that is not decreased.

This object is achieved by the fact that the Hall effect thruster includes a heat sink device comprising a heat sink in contact with the inner wall and of thermal conductivity that is greater than the thermal conductivity of the inner wall, the heat sink being a sleeve and the heat sink device being suitable for discharging heat from the inner wall to the outside of the thruster so as to reduce the temperature difference between the inner wall and the outer wall.

By means of these dispositions, the temperature difference between the inner wall and the outer wall is reduced. Simulations undertaken by the inventors have shown that this reduction contributes to stabilizing the ejection of ions from the discharge channel. This phenomenon is due to the fact that the energy dispersion of the population of electrons that ionize the gas atoms is then reduced, and also to the fact that the atoms of non-ionized gas that strike the cooler, inner wall present energy that is less dispersed.

BRIEF DESCRIPTION OF THE DRAWINGS

The invention can be well understood and its advantages appear better on reading the following detailed description of an embodiment given by way of non-limiting example. The description refers to the accompanying drawing, in which.

MORE DETAILED DESCRIPTION

Figure 1:
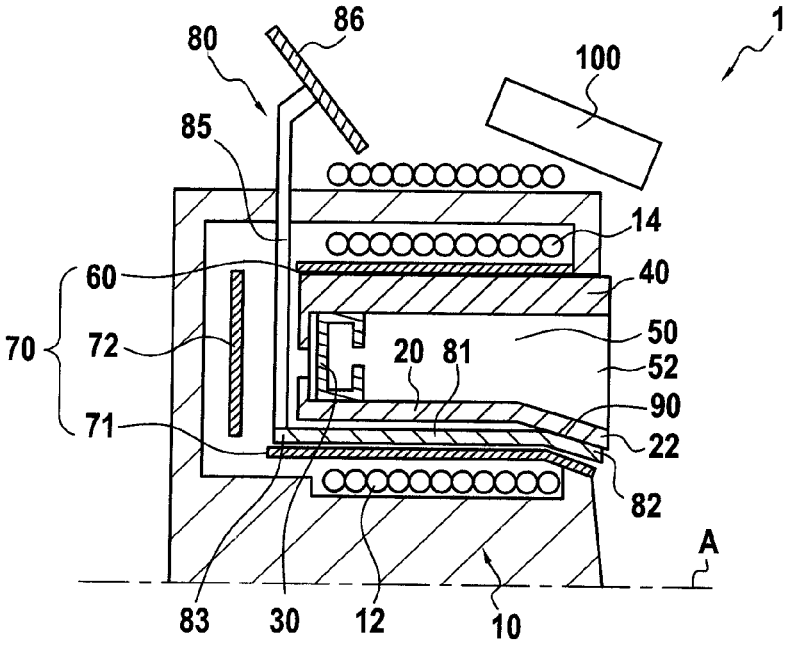
FIG. 1 is a longitudinal section view of a Hall effect thruster of the invention.
Figure 2:
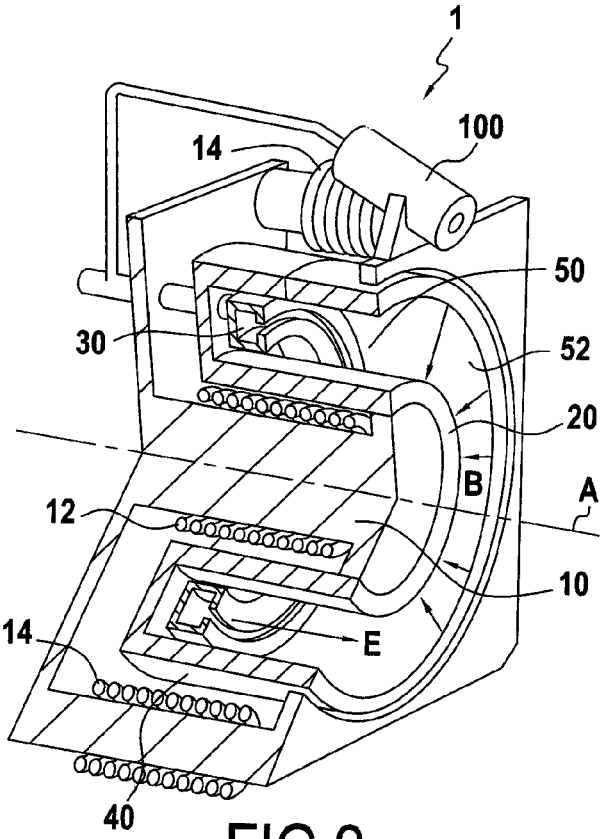
FIG.2 PRIOR ART
FIG. 2, described above, is a view in perspective and partial section showing a prior art Hall effect thruster.

FIG. 1 shows a Hall effect thruster of the invention in longitudinal section. For reasons of symmetry, only half of the thruster on one side of the longitudinal axis A is shown, the cathode 100 also being shown. Parts that are common with the prior art Hall effect thruster shown in FIG. 2 are given identical references and are therefore not described again.

During operation of the Hall effect thruster 1, electrons penetrate into the discharge channel 50 from its downstream end 52 and are forced by the radial magnetic field B to follow substantially circumferential trajectories in the vicinity of said downstream end 52. Some of these electrons strike the inner wall 20 and the outer wall 40 of the discharge channel 50. In addition, some of the ions which are accelerated from upstream towards the downstream end 52 of the discharge channel and some of the non-ionized atoms strike these walls (these ions come from ionization of atoms injected by the injector system 30 into the discharge channel). These impacts between electrons and walls, ions and walls, and atoms and walls lead to the walls being heated. In addition, these walls are also heated by radiation from the plasma.

The outer surface of the inner wall 20, subjected to this heating, is smaller in area than the inner surface of the outer wall 40, likewise subjected to this heating, so the inner wall 20 is heated to a temperature $T_i$ that is well above the temperature $T_e$ to which the outer wall 40 is heated. In some circumstances, this temperature difference $\{T_i - T_e\}$ is greater than 100° C., e.g. 160° C.

According to the invention, a heat sink device 80 is added to the Hall effect thruster. This heat sink device 80 comprises a heat sink 80 fastened to the inner wall 20 of the discharge channel 50 in such a manner as to enable it to remove heat at least from the downstream end 22 of the inner wall 20. It is the downstream end 22 of the inner wall 20 that is the hottest portion of the inner wall 20, since that is where the majority of electrons trapped by the magnetic field B circulate, and where the accelerated ions present a maximum speed. Thus, the temperature difference between the inner wall 20 and the outer wall 40 is reduced, thereby contributing to reducing the instability of the Hall effect thruster 1 while said thruster is operating.

The thermal conductivity of the heat sink 80 is greater than the thermal conductivity of the inner wall 20. The heat sink 81 is thus more effective in removing heat.

Advantageously, the heat sink 81 is thus a sleeve that is in contact with the inside face of the downstream end 22 of the inner wall 20, and it is surrounded by the inner wall 20.

The term "sleeve" is used to mean a hollow cylinder extending along a longitudinal axis (here the axis A) and open at both of its ends along said axis.

The sleeve surrounds the central core 10.

Advantageously, the downstream end 82 of the heat sink 81 is in contact with the inside face of the downstream end 22 of the inner wall 20.

In order to remove heat from the inner wall 20 and discharge it to the outside of the Hall effect thruster 1, the heat sink extends towards the upstream end of the Hall effect thruster 1, and the heat sink device 80 also includes a link element 85 and an external radiator 86, the upstream end of the heat sink 81 being connected by the link element 85 to the radiator 86.

Advantageously, the thermal conductivities of the link element 85 and/or of the external radiator 86 are greater than the thermal conductivity of the inner wall 20. This makes removal of heat by the heat sink device 80 more effective.

Given that the heat sink 81 is fastened directly to the downstream end 22 of the inside face of the inner wall 20, it can remove heat by conduction. Advantageously, the heat sink does not touch other portions of the inner wall 20 such that the heat it removes is not returned to said inner wall 20.

Advantageously, the external radiator 86 extends radially outside the assembly formed by the majority of the other elements of the Hall effect thruster 1, in particular outside the coils 14. Because the heat sink 81 is connected by the link element 85 to the radiator 86 that extends to outside the Hall effect thruster 1 it is possible to achieve more effective removal of heat.

For example, the link element 85 is an annular plate that extends the upstream end 83 of the heat sink 81 radially, the radially outer end of the plate being extended by the radiator 86 which is shaped so as to provide as great as possible an area for dumping heat.

Calculations performed by the inventors show that the temperature difference between the inner wall 20 and the outer wall 40 is less than 100° C. for a Hall effect thruster 1 provided with a heat sink, whereas said difference is more than 160° C. for a prior art Hall effect thruster.

The heat sink 81 is fastened to the inner wall 20 in such a manner as to be in contact with said inner wall over a contact surface 90. This fastening is designed to have as long a lifetime as possible so as to ensure that heat can be removed via the heat sink 81 over the long term.

For example, the heat sink 81 is fastened directly to the inner wall 20 by brazing, with the coefficients of thermal expansion of the heat sink 81 and of the inner wall 20 being substantially equal.

The contact surface 90 is thus the brazing surface. Because the coefficients of thermal expansion are substantially equal, it is possible to minimize any risk of the heat sink 81 separating from the inner wall 20 via the brazing.

Advantageously, the heat sink 81 is made of carbon.

Advantageously, the link element 85 and/or the external radiator 86 are made of carbon.

Carbon presents good thermal conductivity, and also presents a coefficient of thermal expansion that is close to that of boron nitride with silica $BNSiO_2$, which is the material that is used for making the ceramic inner wall 20.

Alternatively, the ceramic inner wall 20 may be made of some other ceramic, or of a material other than a ceramic.

Advantageously, the heat sink 81 is coated at least in part in a coating material of thermal conductivity that is at least equal to that of carbon.

The thermal conductivity of the coating is preferably greater than that of carbon.

Thus, the thermal conductivity of the heat sink 81 is improved compared with an uncoated part made of carbon.

For example, the coating material is selected from the group comprising copper, polycrystalline cubic carbon, and nickel.

The coating may cover all or part of the heat sink, in particular it may cover all of the heat sink apart from the contact surface 90.

Advantageously, the contact surface 90 of the heat sink 81, prior to being connected to the inner wall 20, is coated in nickel (Ni), thereby serving to improve the thermal connection between the carbon of the heat sink 81 and the ceramic of the inner wall 20.

Advantageously, the Hall effect thruster 1 of the invention also includes a set 70 of thermal barriers that are positioned along at least part of the heat sink device 80 so as to contribute to preventing the heat conveyed by the heat sink device 80 being dissipated within said thruster 1.

By way of example, the assembly 70 comprises a first thermal barrier 71 that is a sleeve extending axially along the axis A covering the inside face of the heat sink 81 so that the heat sink 81 is situated in the annular space defined by the inner wall 20 and the first thermal barrier 71.

Thus, the fraction of the heat conveyed by the heat sink 81 that dissipates towards the central core 10 is reduced.

For example, the assembly 70 also includes a second thermal barrier 72 that extends radially along a portion of the link element 85. This second thermal barrier 72 extends substantially from the upstream end 83 of the heat sink 81 and is situated upstream from the link element 85.

Thus, the friction of the heat conveyed by the link element 85 that is dissipated in transit is reduced.

Furthermore, the Hall effect thruster 1 has a third thermal barrier 60 that extends axially along the outside face of the outer wall 40. The third thermal barrier 60 contributes to slowing dissipation of heat from the outer wall 40 to the outside of the Hall effect thruster 1. Thus, the temperature difference between the outer wall 40 and the hotter inner wall 20 is reduced.

For example, the thermal barriers 71, 72, and 60 are made of metal.

For example, each of the thermal barriers 71, 72, and 60 is constituted by a metal element separated by a vacuum.

What is claimed is:

1. A Hall effect thruster having a discharge channel of annular shape extending along an axis, said discharge channel being defined by an outer wall of annular shape and an inner wall of annular shape situated inside a space defined by said outer wall, a cathode situated outside said discharge channel, and an injector system situated at an upstream end of said discharge channel and also forming an anode, a downstream end of said discharge channel being open, wherein said thruster includes a heat sink device comprising a heat sink in contact with said inner wall and of thermal conductivity that is greater than the thermal conductivity of said inner wall, said heat sink being a sleeve, being distinct from a central core, and said heat sink device being suitable for discharging heat from said inner wall to the outside of said thruster so as to reduce the temperature difference between said inner wall and said outer wall, wherein said thruster further comprises a set of thermal barriers that are positioned along at least part of said heat sink device, said set comprising a first thermal barrier that is a sleeve extending axially along said axis and covering the inside face of the heat sink so that said heat sink is situated in the annular spaced defined by said inner wall and said first thermal barrier, so as to reduce the fraction of the heat that dissipates toward said central core.

2. A Hall effect thruster according to claim 1, wherein said heat sink is in contact with an inside face of the downstream end of said inner wall and is surrounded by said inner wall.

3. A Hall effect thruster according to claim 1, wherein a downstream end of said heat sink is in contact with an inside face of the downstream end of said inner wall.

4. A Hall effect thruster according to claim 1, wherein said heat sink extends towards an upstream end of said thruster, and wherein said heat sink device further includes a link element and an external radiator, an upstream end of said heat sink being connected by said link element to said radiator.

5. A Hall effect thruster according to claim 1, wherein said heat sink is fastened directly to said inner wall by brazing, the coefficients of thermal expansion of said heat sink and of said inner wall being substantially equal.

6. A Hall effect thruster according to claim 1, wherein said heat sink is made of carbon.

7. A Hall effect thruster according to claim 6, wherein said heat sink is coated at least in part in a coating material of thermal conductivity that is at least equal to that of carbon.

8. A Hall effect thruster according to claim 7, wherein said coating material is selected from a group comprising copper, polycrystalline cubic carbon, and nickel.

9. A Hall effect thruster according to claim 1, wherein a material of said inner wall is a ceramic.

10. A Hall effect thruster according to claim 9, wherein said ceramic is boron nitride with silica $BNSiO_2$.

* * * * *